US007637542B2

(12) United States Patent
Suzumura et al.

(10) Patent No.: US 7,637,542 B2
(45) Date of Patent: Dec. 29, 2009

(54) DOOR LOCK APPARATUS

(75) Inventors: Makoto Suzumura, Chita (JP); Akira Muramatsu, Chiryu (JP); Sigeru Tanabe, Obu (JP); Yukinobu Kunimatsu, Toyoake (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 11/348,234

(22) Filed: Feb. 7, 2006

(65) Prior Publication Data

US 2006/0186674 A1 Aug. 24, 2006

(30) Foreign Application Priority Data

Feb. 23, 2005 (JP) ..... 2005-047497
Mar. 25, 2005 (JP) ..... 2005-089427

(51) Int. Cl.
*E05C 3/16* (2006.01)

(52) U.S. Cl. ..... 292/216; 292/201; 292/DIG. 23

(58) Field of Classification Search ..... 292/201, 292/216, DIG. 23
See application file for complete search history.

(56) References Cited

U.S. PATENT DOCUMENTS 5,169,186 A * 12/1992 Fukumoto et al. ..... 292/201
5,529,355 A * 6/1996 Fukumoto ..... 292/337
5,678,869 A * 10/1997 Yoshikuwa ..... 292/216
6,148,651 A * 11/2000 Roncin ..... 70/264
6,168,216 B1 * 1/2001 Nakajima et al. ..... 292/201
7,192,066 B2 * 3/2007 Ilea et al. ..... 292/201
2001/0050483 A1 * 12/2001 Hanisch et al. ..... 292/216
2004/1026292 * 12/2004 Fukunaga et al. ..... 292/216
2005/0052032 A1 * 3/2005 Ilea et al. ..... 292/216
2005/0104383 A1 * 5/2005 Ottino ..... 292/216
2005/0140148 A1 * 6/2005 Stoof et al. ..... 292/216

(Continued)

FOREIGN PATENT DOCUMENTS

DE 103 36 049 A1 2/2005

(Continued)

OTHER PUBLICATIONS

Extended European Search Report issued by the European Patent Office in Corresponding EP Patent Application No. 06 10 1161, Feb. 5, 2008, Munich DE.

*Primary Examiner*—Peter M Cuomo
*Assistant Examiner*—Kristina R Fulton
(74) *Attorney, Agent, or Firm*—Buchanan Ingersoll & Rooney PC

(57) ABSTRACT

A door lock apparatus includes a housing for accommodating a latch mechanism for holding a vehicle door to a vehicle body, a lever mechanism actuated when a door handle is operated, a link mechanism for connecting the lever mechanism to the latch mechanism, the link mechanism having a first position for transmitting operational force from the lever mechanism to the latch mechanism and a second position for preventing transmission of the operational force from the lever mechanism to the latch mechanism, and a motor drive mechanism for changing the first and second positions of the link mechanism. The housing includes a first accommodating space for accommodating the motor drive mechanism and a second accommodating space adjacently provided to the first accommodating space for accommodating the latch mechanism and a water preventing portion is provided for preventing water from entering the first accommodating space from outside the housing.

23 Claims, 4 Drawing Sheets

U.S. PATENT DOCUMENTS

| | | | | |
|---|---|---|---|---|
| 2005/0218662 | A1 * | 10/2005 | Umino | 292/216 |
| 2006/0087129 | A1 * | 4/2006 | Gotou et al. | 292/216 |
| 2006/0202488 | A1 | 9/2006 | Kunst | |

FOREIGN PATENT DOCUMENTS

| | | | |
|---|---|---|---|
| FR | 2 656 030 | A1 | 6/1991 |
| GB | 2 341 889 | A | 3/2000 |
| GB | 2 365 487 | A | 2/2002 |
| JP | 2002-38799 | A | 2/2002 |
| JP | 2003-314116 | | 11/2003 |

* cited by examiner

DOOR LOCK APPARATUS

CROSS REFERENCE TO RELATED APPLICATIONS

This application is based on and claims priority under 35 U.S.C. §119 to Japanese Patent Application 2005-047497, filed on Feb. 23, 2005 and Japanese Patent Application 2005-089427, filed on Mar. 25, 2005, the entire content of which is incorporated herein by reference.

FIELD OF THE INVENTION

This invention generally relates to a door lock apparatus. More specifically, this invention pertains to a door lock apparatus applicable to a vehicle, or the like.

BACKGROUND

Conventionally, a door lock apparatus includes a latch mechanism, a lever mechanism, a link mechanism, and a motor drive mechanism, or the like, provided in a housing (as disclosed in JP2003-314116A; document 1). The latch mechanism changes a state of the vehicle door to the vehicle body between a state where the vehicle door is retained to be closed and a state where the vehicle door is enabled to open. The lever mechanism is actuated when a door opening means such as a door handle, or the like, is operated, and actuates the latch mechanism. The link mechanism and the motor drive mechanism change the state of the door lock apparatus between an unlocked state where the latch mechanism can be actuated and a locked state where the latch mechanism cannot be actuated. In these mechanisms, because the motor drive mechanism is configured from an electric part, if the motor drive mechanism makes contact with water, the electric part will be short-circuited and the short will cause trouble. Accordingly, some waterproofing measures need to be made for the door lock apparatus.

Document 1 discloses a door lock apparatus including two covers (a first cover and a second cover) configuring a housing for protecting parts inside the housing. An edge of each cover is joined to an edge of other cover. Further, in order for inhibiting water from entering the housing through a joint portion of the first cover and the second cover, a third cover is integrally provided over the first cover. Thus, the joint portion is protected from water entering the housing from upper part of the housing. As described above, in the door lock apparatus disclosed in the document 1, water is inhibited from entering the housing from an upper part of the housing, and the water is inhibited from contacting the electric part.

However, in the door lock apparatus disclosed in the document 1, when an boundary end portion is highest in the third cover, when water reaches the boundary end portion, the water droplet moves and spreads along a peripheral end portion of the third cover, and reaches near the joint portion of the first cover and the second cover. In this case, the third cover cannot sufficiently work any more. Then, there can be a danger that water enters the housing through the joint portion of the first cover and the second cover and induces short-circuit of the electric part, or induces other adverse effects, and causes trouble of the door lock apparatus.

A need thus exists for a door lock apparatus, which can inhibit water from approaching and contacting an electric part in a housing with reliability. The present invention has been made in view of the above circumstances and provides such a door lock apparatus.

SUMMARY OF THE INVENTION

According to an aspect of the present invention, a door lock apparatus includes a housing for accommodating a latch mechanism for holding a vehicle door to a vehicle body in a closed state, a lever mechanism actuated when a door handle provided inside or outside the vehicle door is operated, a link mechanism provided between the lever mechanism and the latch mechanism for connecting the lever mechanism to the latch mechanism, the link mechanism having a first position for transmitting operational force from the lever mechanism to the latch mechanism and a second position for preventing transmission of the operational force from the lever mechanism to the latch mechanism, and a motor drive mechanism for changing the first and second positions of the link mechanism. The housing includes a first accommodating space for accommodating the motor drive mechanism and a second accommodating space adjacently provided to the first accommodating space for accommodating the latch mechanism and a water preventing means is provided for preventing water from entering the first accommodating space from outside the housing.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
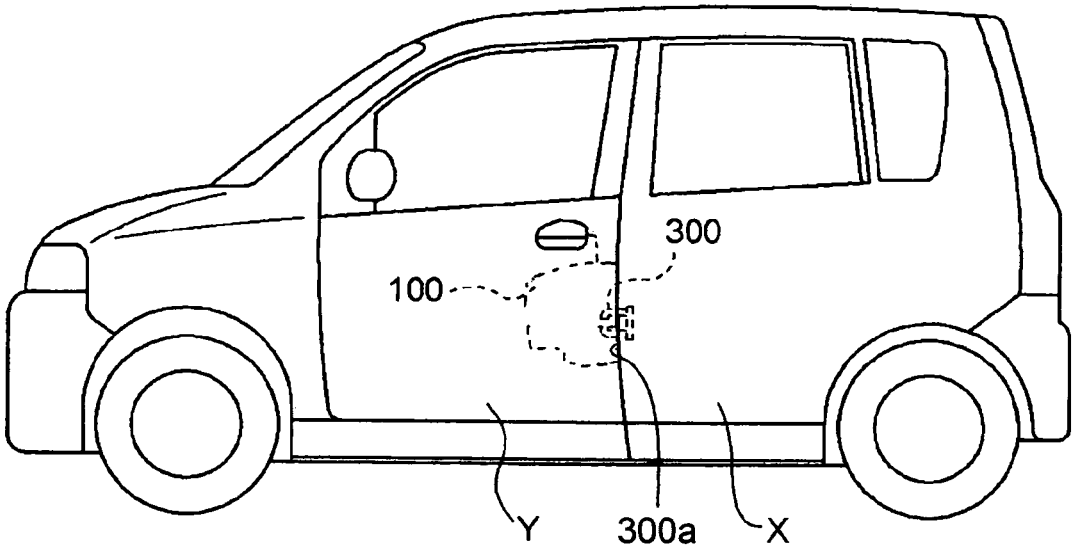
FIG. 1 represents a schematic view illustrating a door lock apparatus according to an embodiment of the present invention installed in a vehicle door.

An embodiment of the present invention will be explained with reference to drawing figures. FIG. 1 represents a schematic diagram illustrating a door lock apparatus 100 according to the embodiment of the present invention. In FIG. 1, the door lock apparatus 100 is installed in a vehicle door Y. The door lock apparatus 100 is installed so as to face a striker 300 provided at a vehicle body X when the vehicle door Y is closed. A type of the vehicle door Y is not particularly limited. The vehicle door Y can be a hinge type door, a sliding door, or the like. Further, in FIG. 1, the door lock apparatus 100 is installed in a side door, serving as the vehicle door Y, for an occupant to get on and off a vehicle. However, it is not limited. The door lock apparatus 100 can be installed in a trunk lid of a hatchback.

Figure 2:
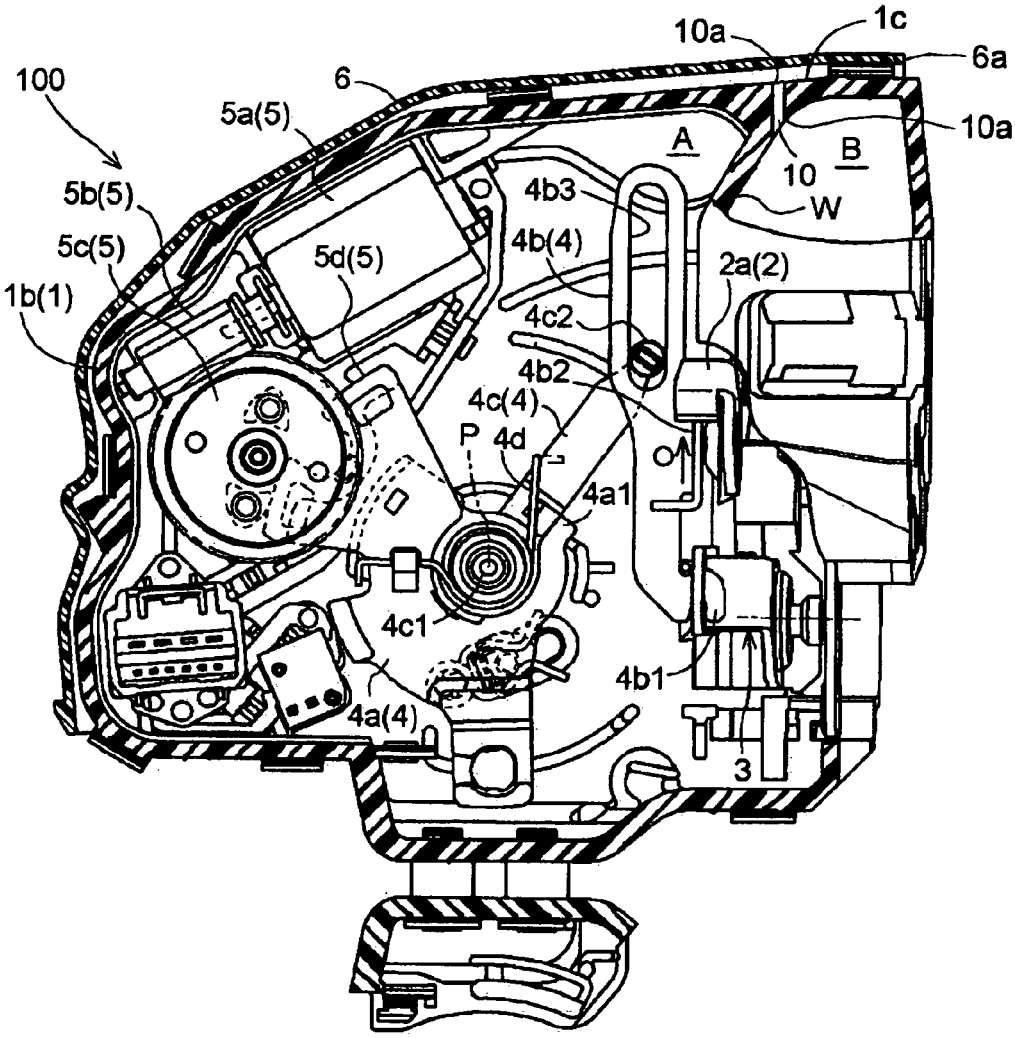
FIG. 2 represents a front view illustrating an inner structure of the door lock apparatus according to the embodiment of the present invention.
Figure 3:
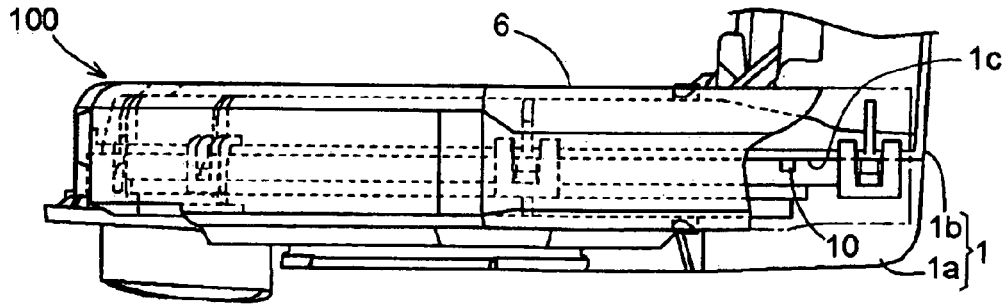
FIG. 3 represents a top view illustrating the door lock apparatus according to the embodiment of the present invention.

Structure of the door lock apparatus 100 will be explained. FIG. 2 represents a front view illustrating inner structure of the door lock apparatus 100 according to the embodiment of the present invention. FIG. 3 represents a top view of the door lock apparatus 100. The door lock apparatus 100 includes a latch mechanism 2, a lever mechanism 3, a link mechanism 4, and a motor drive mechanism 5, provided in a housing 1 made of resin or metal. The housing 1 includes a first cover 1*a* and a second cover 1*b*, each end is joined to other end to form a space inside thereof.

The latch mechanism 2 retains a closed state of the vehicle door Y, in which the door lock apparatus 100 is installed, to the vehicle body X. The latch mechanism 2 includes a guiding portion (not illustrated) for receiving the striker 300, a latch portion (not illustrated) for engaging with the striker 300, and a latch lever 2*a*. The latch portion is actuated by the striker 300, which makes contact with the latch portion in the guiding portion and presses the latch portion. For example, when an occupant closes the vehicle door Y, the latch portion of the latch mechanism 2 makes contact with the striker 300 provided at the vehicle body X and engages with the striker 300. Thus, the vehicle door Y is secured to the vehicle body X. Further, the latch portion is configured to cooperate with rotation of the latch lever 2*a*.

The lever mechanism 3 is operated by operation of a door handle (not illustrated) provided inside or outside of the vehicle door Y, and transmits operational force to the latch mechanism 2. For example, when the vehicle door Y is secured to the vehicle body X, if an occupant operates the door handle, the lever mechanism 3 is operated to release engagement of the latch portion of the latch mechanism 2 with the striker 300. Then, in this released state, if the vehicle door Y is pulled, the vehicle door Y can be opened.

The link mechanism 4 is provided between the lever mechanism 3 and the latch mechanism 2 for connecting the lever mechanism 3 to the latch mechanism 2. The link mechanism 4 can change a first and second position. In the first position, operational force is transmitted from the lever mechanism 3 to the latch mechanism 2. In the second position, transmission of the operational force is prevented. FIG. 2 represents a diagram illustrating an unlocked state in which the operational force can be transmitted from the lever mechanism 3 to the latch mechanism 2 (first position). The link mechanism 4 can be configured from plural members. Explanation of the link mechanism 4 will be made taking an example of a three-link structure configured from an active lever 4*a*, an open link 4*b*, and a sub lever 4*c*.

The active lever 4*a*, which is rotatable about a rotational shaft P, is driven by the motor drive mechanism 5 (described later). The active lever 4*a* includes a protruding portion 4*a*1 for biasing the sub lever 4*c* counterclockwise. Further, around the rotational shaft P of the active lever 4*a*, a spring 4*d* is provided for biasing the sub lever 4*c* clockwise.

The open link 4*b* includes an engaging portion 4*b*1 for engaging with the lever mechanism 3, a contacting portion 4*b*2 for making contact with the latch lever 2*a* of the latch mechanism 2, and a long hole portion 4*b*3. When an occupant operates the door handle and inputs operational force from the lever mechanism 3 to the engaging portion 4*b*1 of the open link 4*b*, the open link 4*b* moves in an upward direction of FIG. 2 (indicated by an arrow), the contacting portion 4*b*2 of the open link 4*b* starts pressing the latch lever 2*a* of the latch mechanism 2, the latch lever 2*a* rotates, and then engagement of the latch portion with the striker 300 is released. In other words, this is an unlocked state of the door lock apparatus 100. When an occupant stops operation of the door handle, the lever mechanism 3 pulls back the engaging portion 4*b*1 of the open link 4*b*, the contacting portion 4*b*2 of the open link 4*b* stops pressing the latch lever 2*a*, the latch lever 2*a* rotates in opposite direction and moves back to an original position, and the latch portion comes back to an initial state.

The sub lever 4*c* connects the active lever 4*a* to the open link 4*b*. Precisely, one end 4*c*1 of the sub lever 4*c* is secured to the rotational shaft P of the active lever 4*a*. The other end 4*c*2 is slidably fitted in the long hole portion 4*b*3 of the open link 4*b*.

Figure 5:
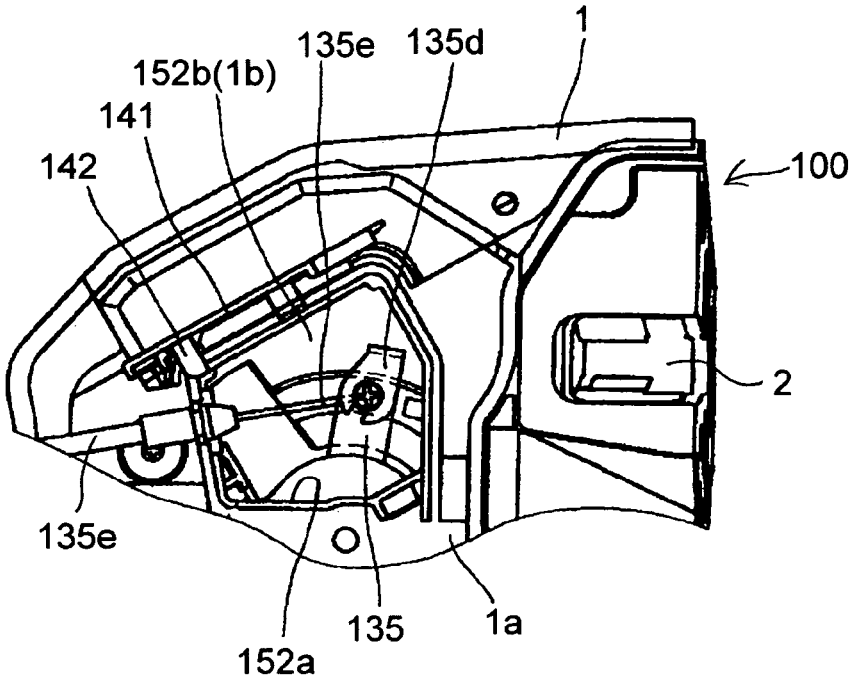
FIG. 5 represents a front view of an opening portion formed at a first cover according to the embodiment of the present invention.
Figure 6:
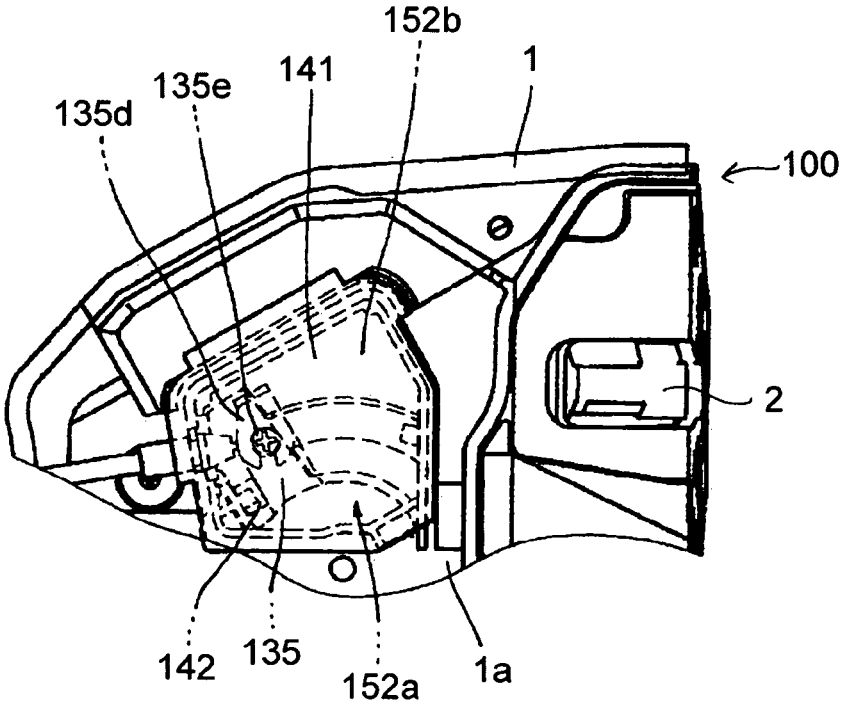
FIG. 6 represents a front view of a lid member placed on the first cover according to the embodiment of the present invention.

When the active lever 4*a* is driven by the motor drive mechanism 5 to rotate counterclockwise, the sub lever 4*c* is biased by the protruding portion 4*a*1 of the active lever 4*a* to rotate about the rotational shaft P counterclockwise. At this time, the other end 4*c*2 of the sub lever 4*c* slidably fitted in the long hole portion 4*b*3 of the open link 4*b* pulls the open link 4*b* to the left direction in FIG. 2. Thus, the contacting portion 4*b*2 of the open link 4*b* becomes out of contact with the latch lever 2*a* of the latch mechanism 2. In this state, when an occupant operates the door handle and transmits operational force to the lever mechanism 3, the open link 4*b* cannot transmit the operational force to the latch mechanism 2. In other words, transmission of the operational force from the lever mechanism 3 to the latch mechanism 2 is prevented. This is a locked state of the door lock apparatus 100. At the front side (as seen in FIG. 2) of the active lever 4*a* of the door lock apparatus 100 illustrated in FIG. 2, an inside open link 135*d* illustrated in FIG. 5 is superposed. The inside open link 135*d* slides along an introducing wall portion 152*b* formed on an outside of the first cover 1*a*. As the inside open link 135*d* moves, the active lever 4*a* illustrated in FIG. 2 moves. The inside open link 135*d* illustrated in FIG. 5 is connected to an inside door handle (not illustrated) through a cable 135*e*. Accordingly, when the inside door handle is operated, the active lever 4*a* illustrated in FIG. 2 is actuated through the cable 135*e* and the inside open link 135*d*. The first cover 1*a* of the housing 1 of the door lock apparatus 100, illustrated in FIG. 5, includes an opening portion 152*a*. Through the opening portion 152*a*, the cable 135*e* is connected to the inside open link 135*d*. As illustrated in FIG. 6, the opening portion 152*a* is covered by a lid member 141. Accordingly, malicious operation of the inside open link 135*d* by thieves can be inhibited. As illustrated in FIG. 5, the lid member 141 includes a protruding regulating portion 142. As illustrated in FIG. 6, when the lid member 141 covers the opening portion 152*a*, the regulating portion 142 regulates movable range of the inside open link 135*d*.

The motor drive mechanism 5 generates driving force for changing a position of the link mechanism 4. The motor drive mechanism 5 includes a motor portion 5*a*, a worm gear 5*b*, a wheel 5*c*, and an output portion 5*d* cooperating with the wheel 5*c*. The output portion 5*d* engages with the active lever 4*a* of the link mechanism 4. Structured as above, rotational driving force generated by the motor portion 5*a* can be transmitted to the active lever 4*a* through the worm gear 5*b*, the wheel 5*c*, and the output portion 5*d*.

Next, arrangement of parts in the housing will be explained. The latch mechanism 2, the lever mechanism 3, the link mechanism 4, and the motor drive mechanism 5 are provided in the housing 1. At the periphery of the housing 1, a joint portion of the first cover 1*a* and the second cover 1*b* is provided. Further, a cover member 6 is provided so as to cover the joint portion. The cover member 6 includes an end portion 6*a* at the latch mechanism 2 side.

Further, in the housing 1, a first accommodating space A and a second accommodating space B are provided. Areas of the first accommodating space A and the second accommodating space B are not definitely determined. The areas of the first accommodating space A and the second accommodating space B can be arbitrarily determined for convenience to some extent. In other words, as illustrated in FIG. 2, when a space is partially separated by a partial separating wall W, an approximate left side portion of the separating wall W can be the first accommodating space A, and an approximate right side portion of the separating wall W can be the second accommodating space B. It is needless to say that an inside space of the housing 1 can be completely separated into discrete compartments.

The reason why the inside space of the housing 1 is separated into two spaces as described above is to accommodate mainly electric parts of the door lock apparatus 100 in one of two spaces and to accommodate non-electric parts in the other of the two spaces. In the embodiment, in the first accommodating space A, at least the motor drive mechanism 5 is provided. In the second accommodating space B, at least the latch mechanism 2 is provided. As described above, an electric part, which is weak against water, such as the motor drive mechanism 5, is accommodated in the first accommodating space A. A non-electric part, which is relatively strong against water, such as the latch mechanism 2, is accommodated in the second accommodating space B. Further, providing a water preventing means, which will be explained below in an example, water proofing property of the door lock apparatus 100 can be ensured, and obtained in simple way. Accordingly, trouble of the door lock apparatus 100 caused by short or the like can be inhibited.

Next, a first embodiment will be explained. This embodiment is a door lock apparatus 100 explained above with reference to FIGS. 2 and 3. The door lock apparatus 100 includes, as a water preventing means, a hole 10 at the housing 1. Water flows through the hole 10 to the second accommodating space B. The housing 1 includes the first cover 1*a* and the second cover 1*b*. The hole 10 is formed at either the first cover 1*a* or the second cover 1*b*. The hole 10 is formed at the upper side of the housing 1. When the door lock apparatus 100 is installed in the vehicle, one end of the second accommodating space B (in other words, the latch mechanism 2) need to be exposed at an outside edge portion 300*a* of the vehicle door Y (illustrated in FIG. 1) because the door lock apparatus 100 need to engage with the striker 300 of the vehicle body X side. The door lock apparatus 100 is provided in the vehicle door Y. Through inside the vehicle door Y, water such as rainwater flows. Accordingly, water such as rainwater reaches the door lock apparatus 100 in the vehicle door Y, reaches the housing 1 from the end portion 6*a* of the cover member 6 illustrated in FIG. 2 through a clearance between the cover member 6 and the housing 1, and enters the housing 1 through a clearance between the first cover 1*a* and the second cover 1*b* illustrated in FIG. 3.

When water enters the clearance between the cover member 6 and the housing 1, the water starts flowing along an upper surface of the housing 1 illustrated in FIG. 2 toward a position above the first accommodating space A. However, because the door lock apparatus 100 in this embodiment has the hole 10 provided at the housing 1 in the middle of a water flow path 1*c*, the water enters the hole 10, and the water is introduced into the second accommodating space B. Accordingly, there cannot be a danger that water approaches or contacts an electric part such as the motor drive mechanism 5 in the first accommodating space A. Thus, trouble of the door lock apparatus 100 can be inhibited. Here, because a part accommodated in the second accommodating space B is a non-electric part such as the latch mechanism 2, trouble of the part in the second accommodating space B does not occur even when water directly contacts. The water having entered the second accommodating space B is discharged to outside the door lock apparatus 100 from a hole (not illustrated), or the like, appropriately provided at a lower part of the door lock apparatus 100.

The hole 10 can be preferably provided near the separating wall W, which defines the first accommodating space A and the second accommodating space B, at an upper portion of the housing at the second accommodating space B side. At this time, the separating wall W can be continuously connected to the hole 10. When the separating wall W and the hole 10 are arranged as described above, water entering the hole 10 can simply flow downward along the second accommodating space B side of the separating wall W, serving as an introducing means, into the second accommodating space B. Further, for simply introducing the water flowing along the upper surface of the housing 1, an inner periphery 10*a* of the hole 10 can be processed by means of round chamfering.

Figure 4A:
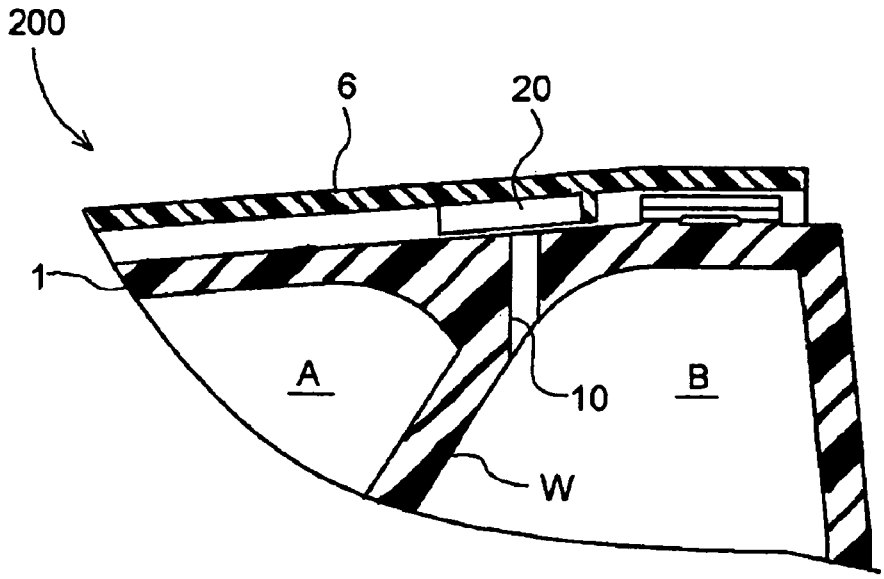
FIG. 4A represents a partial front view illustrating a partial structure of a door lock apparatus according to a second embodiment of the present invention.
Figure 4B:
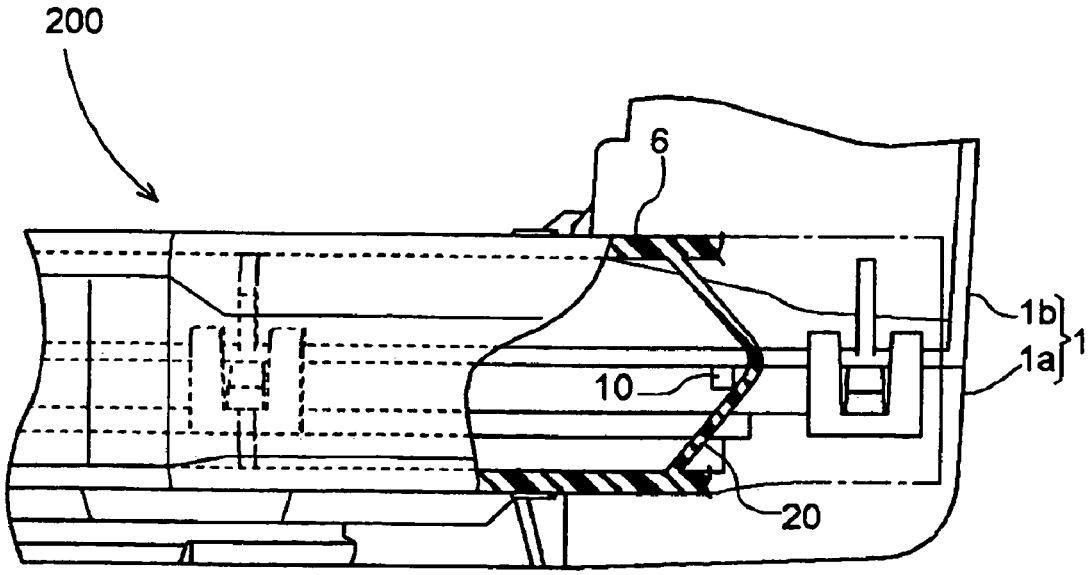
FIG. 4B represents a partial top view of the door lock apparatus according to the second embodiment of the present invention.

Next, a second embodiment will be explained. FIG. 4A represents a partial front view illustrating a partial structure of a door lock apparatus 200 according to a second embodiment of the present invention. FIG. 4B represents a partial top view illustrating the door lock apparatus 200. The door lock apparatus 200 according to this embodiment includes a V-shaped water stopping plate 20 in addition to the hole 10. Structure other than the water stopping plate 20 is the same as that of the door lock apparatus 100 according to the first embodiment.

The water stopping plate 20 can be provided on an upper surface side of the housing 1 in an area from an end portion of the cover member 6 to a position above the first accommodating space A. More specifically, the water stopping plate 20 can be provided near the upper surface of the housing 1 above the second accommodating space B. Water such as rainwater enters a clearance between the second accommodating space B side of the cover member 6 and the housing 1, flows along the upper surface of the housing 1, and flows toward a position above the first accommodating space A in the same way as in the first embodiment. However, the water stopping plate 20 inhibits the water from reaching the position above the first accommodating space A. Accordingly, approach and contact of water does not occur for an electric part such as the motor drive mechanism 5 in the first accommodating space A. Therefore, trouble of the door lock apparatus 200 can be inhibited.

The water stopping plate 20 can be directly provided on the upper surface of the housing 1. The water stopping plate 20 can also be integrally provided on a lower surface of the cover member 6 for covering the joint portion of the first cover 1*a* and the second cover 1*b*. In this case, the number of parts can be decreased and a process for placing the water stopping plate 20 can be eliminated. A lower end of the water stopping plate 20 and the upper surface of the housing 1 can be closely in contact. The lower end of the water stopping plate 20 and the upper surface of the housing 1 can be placed with a clearance therebetween to some extent. Even when a clearance is provided therebetween, water can be trapped in the clearance by effect of surface tension of the water. Accordingly, water can be inhibited from entering the first accommodating space A side of the clearance with reliability.

In this embodiment, in order for enhancing water-stopping effect, the water stopping plate 20 is provided in addition to the hole 10 according to the first embodiment. However, it is not limited. The stopping plate 20 can be solely provided as the water preventing means.

A door lock apparatus according to the embodiment of the present invention can be applied to a vehicle door. In addition, the door lock apparatus can be applied to a sunroof opening/closing apparatus, a hood opening/closing apparatus, or the like. In addition, application of the door lock apparatus is not limited to automotive industry. The door lock apparatus can be applied to anything having an opening/closing means, for example, a door for a building, a door of access opening of an electric appliance, or the like.

According to an aspect of the present invention, a door lock apparatus includes a housing for accommodating a latch mechanism for holding a vehicle door to a vehicle body in a closed state, a lever mechanism actuated when a door handle provided inside or outside the vehicle door is operated, a link mechanism provided between the lever mechanism and the latch mechanism for connecting the lever mechanism to the latch mechanism, the link mechanism having a first position for transmitting operational force from the lever mechanism to the latch mechanism and a second position for preventing transmission of the operational force from the lever mechanism to the latch mechanism, and a motor drive mechanism for changing the first and second positions of the link mechanism. The housing includes a first accommodating space for accommodating the motor drive mechanism and a second accommodating space adjacently provided to the first accommodating space for accommodating the latch mechanism and a water preventing means is provided for preventing water from entering the first accommodating space from outside the housing.

According to the aspect of the present invention, the first accommodating space and the second accommodating space are provided in the housing. The first accommodating space accommodates the motor drive mechanism. The second accommodating space accommodates the latch mechanism. In this situation, water preventing means prevents water entering the first accommodating space from outside the housing. Therefore, there cannot be a danger that water approaches and contacts an electric part such as the motor drive mechanism. Accordingly, trouble of the door lock apparatus can be inhibited.

According to a further aspect of the present invention, the water preventing means can be a hole provided at the housing for letting water flow into the second accommodating space.

According to the aspect of the present invention, water such as rainwater flows down the hole into the second accommodating space before the water reaches a position above the first accommodating space. Accordingly, there cannot be a danger that water approaches and contacts an electric part such as the motor drive mechanism in the first accommodating space. Therefore, trouble of the door lock apparatus can be inhibited.

According to a further aspect of the present invention, the water preventing means can be a water stopping plate provided near an upper surface of the housing above the second accommodating space.

According to the aspect of the present invention, water such as rainwater is blocked by the water stopping plate before the water moves to the position above the first accommodating space. Accordingly, there cannot be a danger that water approaches and contacts an electric part such as the motor drive mechanism in the first accommodating space. Therefore, trouble of the door lock apparatus can be inhibited.

According to a further aspect of the present invention, the door lock apparatus can further include a cover member for covering an upper surface side of the housing. The cover member has an end portion at the latch mechanism side. The water preventing means can be provided on or above the upper surface of the housing in an area from the end portion of the cover member to a position above the first accommodating space.

According to the aspect of the present invention, because the cover member for covering the upper surface side of the housing includes the end portion at the latch mechanism side, water such as rainwater enters from the position above the second accommodating space. When the water preventing means is provided on the upper surface side of the housing in an area from the end portion of the cover member to the position above the first accommodating space, the water preventing means can block the water between the cover member and the housing member from entering the position above the first accommodating space from the position above the second accommodating space with reliability.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door lock apparatus accommodated in a vehicle door, comprising:

a latch mechanism for holding the vehicle door to a vehicle body in a closed state, a housing accommodating the latch mechanism, a lever mechanism actuated when a door handle provided inside or outside the vehicle door is operated, a link mechanism provided between the lever mechanism and the latch mechanism to connect the lever mechanism to the latch mechanism, the link mechanism having a first position for transmitting operational force from the lever mechanism to the latch mechanism and a second position for preventing transmission of the operational force from the lever mechanism to the latch mechanism, and a motor drive mechanism changing the first and second positions of the link mechanism, wherein the housing includes a first accommodating space accommodating the motor drive mechanism and a second accommodating space which is adjacently provided to the first accommodating space in a lateral direction of the door lock apparatus and accommodating the latch mechanism, and the apparatus further includes a water preventing means including a hole provided at a top portion of an upper side of the housing and connecting the outside of the housing and the second accommodating space so that the outside of the housing and the second accommodating space are in communication with each other via the hole to let water flow into the second accommodating space so as to prevent water from entering the first accommodating space from the outside of the housing, wherein the upper side of the housing faces an upper side of the vehicle door.

2. The door lock apparatus according to claim 1, wherein the water preventing means includes a water stopping plate provided near an upper surface of the housing above the second accommodating space.

3. The door lock apparatus according to claim 1, further comprising a cover member for covering an upper surface side of the housing, the cover member having an end portion at the latch mechanism side, wherein the water preventing means is provided on or above the upper surface of the housing in an area from the end portion of the cover member to a position above the first accommodating space.

4. The door lock apparatus according to claim 1, wherein the first accommodating space and the second accommodating space are defined by a separating wall provided in the housing.

5. The door lock apparatus according to claim 4, wherein the separating wall is continuously connected to the water preventing means.

6. The door lock apparatus according to claim 1, wherein the water preventing means is provided at the second accommodating space side from a position between the first accommodating space and the second accommodating space.

7. The door lock apparatus according to claim 1, wherein one end of the housing at the second accommodating space side is exposed at an outside edge portion of the vehicle door.

8. The door lock apparatus according to claim 1, wherein an inner periphery of the hole is processed by means of round chamfering.

9. The door lock apparatus according to claim 1, wherein the housing includes an opening portion through which the lever mechanism and the door handle are linked.

10. The door lock apparatus according to claim 9, further comprising a lid member for covering the opening portion of the housing.

11. The door lock apparatus according to claim 10, wherein the lid member includes a regulating portion for regulating movement of the lever mechanism.

12. The door lock apparatus according to claim 1, wherein the housing includes a first cover and a second cover.

13. The door lock apparatus according to claim 12, wherein the water preventing means is provided at either one of the first cover and the second cover.

14. The door lock apparatus according to claim 1, further comprising a cover member for covering an upper surface side of the housing, the cover member having an end portion at the latch mechanism side, wherein the water preventing means is provided on or above the upper surface of the housing in an area from the end portion of the cover member to a position above the first accommodating space.

15. The door lock apparatus according to claim 2, further comprising a cover member for covering the upper surface side of the housing, the cover member having an end portion at the latch mechanism side, wherein the water preventing means is provided on or above the upper surface of the housing in an area from the end portion of the cover member to a position above the first accommodating space.

16. A door lock apparatus accommodated in a vehicle door, comprising a latch mechanism for holding the vehicle door to a vehicle body in a closed state, a housing accommodating the latch mechanism, a lever mechanism actuated when a door handle provided inside or outside the vehicle door is operated, a link mechanism provided between the lever mechanism and the latch mechanism to connect the lever mechanism to the latch mechanism, the link mechanism having a first position for transmitting operational force from the lever mechanism to the latch mechanism and a second position for preventing transmission of the operational force from the lever mechanism to the latch mechanism, a motor drive mechanism changing the first and second positions of the link mechanism, the housing including a first accommodating space accommodating the motor drive mechanism and a second accommodating space which is adjacently provided to the first accommodating space in a lateral direction of the door lock apparatus and accommodating the latch mechanism, and water preventing means including a hole provided at a top portion of an upper side of the housing and connecting the outside of the housing and the second accommodating space so that the outside the housing and the second accommodating space are in communication with each other via the hole to let water flow into the second accommodating space from a water flow path between the cover member and the upper surface side of the housing, wherein the upper side of the housing faces an upper side of the vehicle door.

17. The door lock apparatus according to claim 16, wherein the water preventing means includes a water stopping plate provided near an upper surface of the housing above the second accommodating space.

18. The door lock apparatus according to claim 1, wherein the second accommodating space is horizontally adjacent to the first accommodating space.

19. The door lock apparatus according to claim 16, wherein the second accommodating space is horizontally adjacent to the first accommodating space.

20. A door lock apparatus, comprising a latch mechanism for holding a vehicle door to a vehicle body in a closed state, a housing accommodating the latch mechanism, a lever mechanism actuated when a door handle provided inside or outside the vehicle door is operated, a link mechanism provided between the lever mechanism and the latch mechanism to connect the lever mechanism to the latch mechanism, the link mechanism having a first position for transmitting operational force from the lever mechanism to the latch mechanism and a second position for preventing transmission of the operational force from the lever mechanism to the latch mechanism, a motor drive mechanism changing the first and second positions of the link mechanism, the housing including a first accommodating space accommodating the motor drive mechanism and a second accommodating space which is adjacently provided to the first accommodating space in a lateral direction of the door lock apparatus and accommodating the latch mechanism, a cover member for covering an upper surface side of the housing so that a space exists between the cover member and the upper surface side of the housing, the space defining a water flow path, and water preventing means including a hole provided at the housing so that the outside of the housing and the second accommodating space are in communication with each other via the hole, the hole communicating the water flow path and the second accommodating space to let water flow into the second accommodating space so as to prevent water in the water flow path from entering the first accommodating space.

21. The door lock apparatus according to claim 1, wherein an upper portion of the housing forming an upper portion of the first accommodating space and an upper portion of the housing forming an upper portion of the second accommodating space are positioned so as to be adjacent to one another in the lateral direction of the door lock apparatus.

22. The door lock apparatus according to claim 16, wherein an upper portion of the housing forming an upper portion of the first accommodating space and an upper portion of the housing forming an upper portion of the second accommodating space are positioned so as to be adjacent to one another in the lateral direction of the door lock apparatus.

23. The door lock apparatus according to claim 20, wherein an upper portion of the housing forming an upper portion of the first accommodating space and an upper portion of the housing forming an upper portion of the second accommodating space are positioned so as to be adjacent to one another in the lateral direction of the door lock apparatus.

* * * * *